US006820421B2

(12) United States Patent
Kalina

(10) Patent No.: US 6,820,421 B2
(45) Date of Patent: Nov. 23, 2004

(54) LOW TEMPERATURE GEOTHERMAL SYSTEM

(75) Inventor: Alexander I. Kalina, Hillsborough, CA (US)

(73) Assignee: Kalex, LLC, Belmont, CA (US)

( * ) Notice: Subject to any disclaimer, the term of this patent is extended or adjusted under 35 U.S.C. 154(b) by 10 days.

(21) Appl. No.: 10/252,744

(22) Filed: Sep. 23, 2002

(65) Prior Publication Data

US 2004/0055302 A1 Mar. 25, 2004

(51) Int. Cl.[7] ..... F01K 25/06; F03G 7/00

(52) U.S. Cl. ..... 60/649; 60/641.2; 60/641.5; 60/651; 60/653; 60/655; 60/671; 60/673

(58) Field of Search ..... 60/649, 651, 671, 60/653, 641.2, 673, 641.5, 655

(56) References Cited

U.S. PATENT DOCUMENTS

| | | | | |
|---|---|---|---|---|
| 4,346,561 A | | 8/1982 | Kalina | 60/673 |
| 4,489,563 A | | 12/1984 | Kalina | 60/673 |
| 4,548,043 A | | 10/1985 | Kalina | 60/673 |
| 4,586,340 A | | 5/1986 | Kalina | 60/649 |
| 4,604,867 A | | 8/1986 | Kalina | 60/653 |
| 4,674,285 A | | 6/1987 | Durrant et al. | 60/646 |
| 4,732,005 A | | 3/1988 | Kalina | 60/649 |
| 4,763,480 A | | 8/1988 | Kalina | 60/649 |
| 4,899,545 A | | 2/1990 | Kalina | 60/673 |
| 4,982,568 A | * | 1/1991 | Kalina | 60/649 |
| 5,029,444 A | * | 7/1991 | Kalina | 60/649 |
| 5,095,708 A | | 3/1992 | Kalina | 60/673 |
| 5,440,882 A | * | 8/1995 | Kalina | 60/641.2 |
| 5,450,821 A | | 9/1995 | Kalina | 122/1 R |
| 5,572,871 A | | 11/1996 | Kalina | 60/649 |
| 5,588,298 A | | 12/1996 | Kalina et al. | 60/676 |
| 5,603,218 A | | 2/1997 | Hooper | 60/655 |
| 5,649,426 A | | 7/1997 | Kalina et al. | 60/649 |
| 5,754,613 A | * | 5/1998 | Hashiguchi et al. | 60/649 |
| 5,822,990 A | | 10/1998 | Kalina et al. | 60/649 |
| 5,950,433 A | | 9/1999 | Kalina | 60/649 |
| 5,953,918 A | * | 9/1999 | Kalina et al. | 60/653 |
| 6,347,520 B1 | * | 2/2002 | Ranasinghe et al. | 60/649 |

FOREIGN PATENT DOCUMENTS

JP 7-94815 B2 * 10/1995 ..... F03G/7/05

OTHER PUBLICATIONS

NEDO Brochure, "ECO–Energy City Project", 1994.
NEDO Roport published 1996, pp. 4–6, 4–7, 4–43, 4–63, 4–53.

* cited by examiner

*Primary Examiner*—Sheldon J. Richter

(57) ABSTRACT

A new thermodynamic cycle is disclosed for converting energy from a low temperature stream from an external source into useable energy using a working fluid comprising of a mixture of a low boiling component and a high boiling component. The cycle is designed to improve the efficiency of the energy extraction process by mixing into an intermediate liquid stream an enriched liquid stream from which the energy from the external source stream is extracted in a vaporization step and converted to energy in an expansion step. The new thermodynamic process and the system for accomplishing it are especially well-suited for streams from low-temperature geothermal sources.

17 Claims, 5 Drawing Sheets

LOW TEMPERATURE GEOTHERMAL SYSTEM

BACKGROUND OF THE INVENTION

1. Field of the Invention

The present invention relates to a process and system to convert thermal energy from low temperature sources, especially from low temperature geothermal fluids, into mechanical and/or electrical energy.

More particularly, the present invention relates to a process and system to convert thermal energy from moderately low temperature sources, especially from geothermal fluids, into mechanical and electrical energy, where a working fluid comprises a mixture of at least two components, with the preferred working fluid comprising a water-ammonia mixture. The present invention also relates to a novel thermodynamic cycle or process and a system to implement it.

2. Description of the Related Art

Prior art methods and systems for converting heat into useful energy are well documented in the art. In fact, many such methods and systems have been invented and patented by the inventor. These prior art systems include U.S. Pat. Nos.: 4,346,561, 4,489,563, 4,548,043, 4,586,340, 4,604,867, 4,674,285, 4,732,005, 4,763,480, 4,899,545, 4,982,568, 5,029,444, 5,095,708, 5,440,882, 5,450,821, 5,572,871, 5,588,298, 5,603,218, 5,649,426, 5,822,990, 5,950,433 and 5,953,918; Foreign References: JP 94815 B2 and Journal References: NEDO Brochure, "ECO-Energy City Project", 1994 and NEDO Report published 1996, pp. 4–6, 4–7, 4–43, 4–63, 4–53, incorporated herein by reference.

Although all of these prior art systems and methods relate to the conversion of thermal energy into other more useful forms of energy from moderately low temperature sources, all suffer from certain inefficiencies. Thus, there is a need in the art for an improved system and method for converting thermal energy from moderately low temperature sources to more useful forms of energy, especially for converting geothermal energy from moderately low temperature geothermal streams into more useful forms of energy.

SUMMARY OF THE INVENTION

The present invention provides a method for implementing a thermodynamic cycle comprising the steps of expanding a gaseous working stream, transforming its energy into usable form and producing a spent stream. After expansion and work extraction, the spent stream is mixed with at least one lean stream to form a lean spent stream. The lean spent stream is then used to heat a liquid first working stream to form a heated first working stream and a pre-condensed stream which is then condensed to form a liquid stream. The liquid stream is then mixed with an enriched stream to formn the liquid first working stream. A portion of this stream is then depressurized to an intermediate pressure and separated into an enriched vapor stream and the lean stream; while a second portion of the liquid first working stream is heated to form the gaseous working stream.

The present invention provides a method for implementing a thermodynamic cycle comprising the steps of expanding a gaseous second working stream, transforming its energy into usable form and producing a low pressure spent stream. After expansion, the spent stream is mixed with a first lean stream forming a lean spent stream. Heat is then transferred from this stream to a first working solution to form a heated first working solution. The cooled lean spent stream is then mixed with a second lean stream to form a pre-condensed stream, which is then condensed to form a liquid stream. The liquid stream is then mixed with a first enriched vapor stream to form the first working solution. A first portion of the heated first working stream is separated into a second enriched vapor stream and the second lean stream. A second portion of the heated first working stream is then heated with an external heat source fluid stream to form a partially vaporized first working stream. The partially vaporized first working stream is then separated into a fourth enriched stream and a third lean stream. A first portion of the third lean stream is then separated into the first lean stream and a third enriched stream and the third enriched stream is mixed with the second enriched stream to form the first enriched stream. A second portion of the third lean stream is mixed with the fourth enriched stream to form the second working stream, which is then fully vaporized to from the gaseous second working stream.

DESCRIPTION OF THE DRAWINGS

The invention can be better understood with reference to the following detailed description together with the appended illustrative drawings in which like elements are numbered the same.

DETAILED DESCRIPTION OF THE INVENTION

The inventors have found that a system utilizing a novel thermodynamical cycle (process) can be designed to increase the work output derived from low temperature heat sources. The system and the process or method use a working fluid comprising a mixture of at least two components. The preferred working fluid for the systems and processes of this invention is a water-ammonia mixture, though other mixtures, such as mixtures of hydrocarbons and/or Freons can be used with practically the same results. The systems and methods of this invention are more efficient for converting heat from relatively low temperature geothermal source into a more useful form of energy. The system uses a multi-component basic working fluid to extract energy from one or more (at least one) geothermal source streams in one or more (at least one) heat exchangers or heat exchanges zones. The heat exchanged basic working fluid then transfers its gained thermal energy to one or more (at least one) turbines and the turbines convert the gained thermal energy into mechanical energy and/or electrical energy. The system also includes pumps to increase the pressure of the basic working fluid at certain points in the system and one or more (at least one) heat Exchangers which bring the basic working fluid in heat exchange relationships with one or more (at least one) cool streams. One novel feature of the systems and methods of this invention, and one of the features that increases the efficiency of the systems, is the result of absorbing a vapor stream into the condensed liquid working solution stream prior to fully pressurization via pumping. The vapor stream changes the composition of the solution prior to heating and vaporization by the geothermal stream.

The basic working fluid used in the systems of this inventions preferably is a multi-component fluid that comprises a lower boiling point fluid—the low-boiling component—and a higher boiling point fluid—the high-boiling component. Preferred working fluids include an ammonia-water mixture, a mixture of two or more hydrocarbons, a mixture of two or more freon, a mixture of hydrocarbons and freon, or the like. In general, the fluid can comprise mixtures of any number of compounds with favorable thermodynamic characteristics and solubility. In a particularly preferred embodiment, the fluid comprises a mixture of water and ammonia.

Figure 1A:
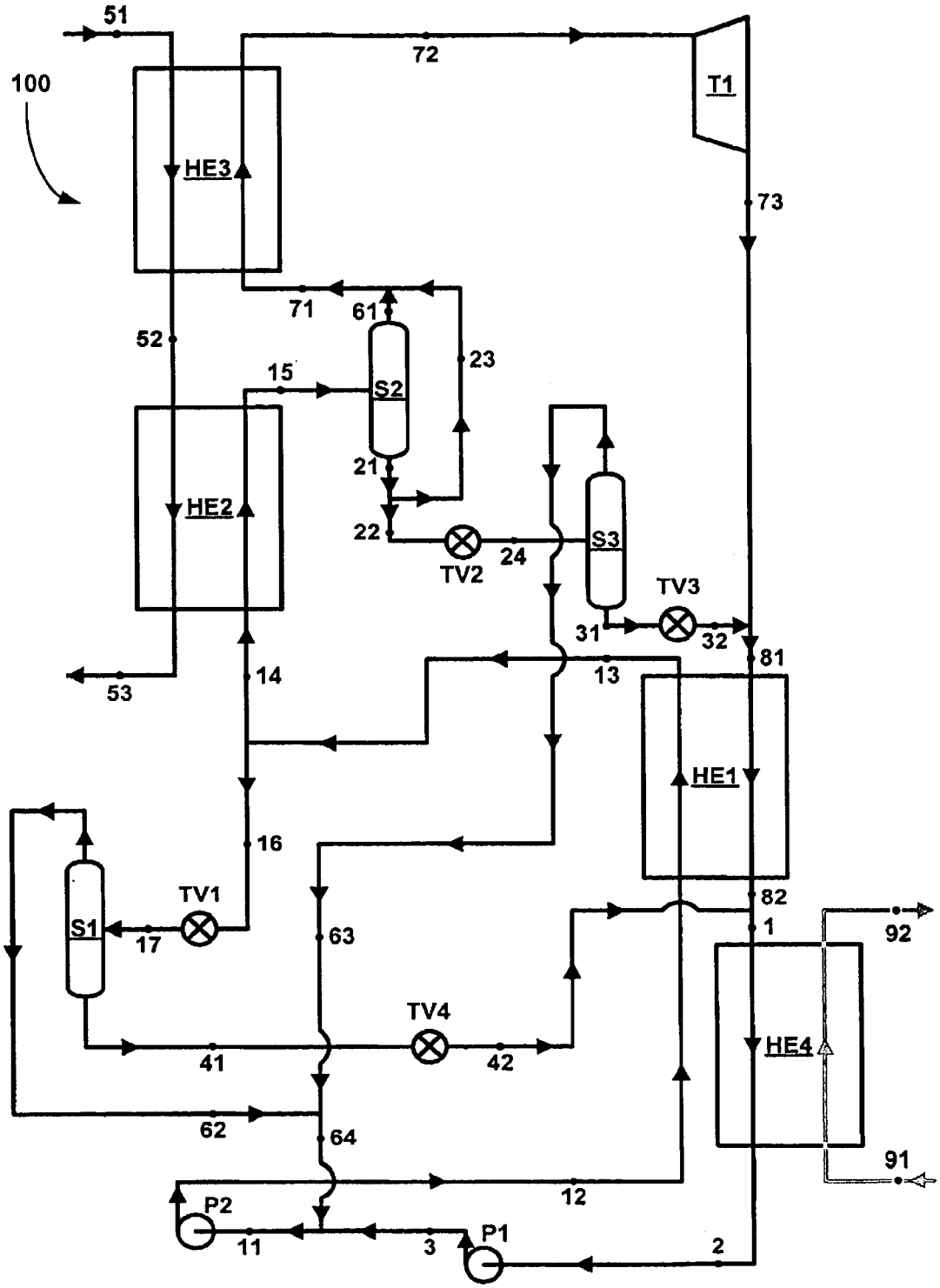
FIGS. 1A&B depict a diagram of a preferred embodiment of a system of this invention for converting heat from a geothermal source to a useful form of energy.

Referring now to FIG. 1A, a flow diagram, generally 100, is shown that illustrates a preferred embodiment a system and method of energy conversion of this invention and will be described in terms of its components and its operation.

A fully condensed basic solution of working fluid with parameters as at a point 2 enters into a pump P1, where it is pumped to a chosen, elevated pressure, (hereafter referred to as the "intermediate pressure"), and obtains parameters as at a point 3. The basic working solution at the point 2 is in a state of a saturated liquid, and as a result of increasing pressure in the process 2–3 obtains a state of sub-cooled liquid. The stream of sub-cooled liquid, having parameters as at the point 3, is mixed with a stream of vapor having parameters as at a point 64 (see below). This vapor, with parameters as at the point 64, has a significantly higher concentration of the low boiling component, (e.g., in case of water-ammonia basic working solution, the solution would have a higher concentration of ammonia), than the liquid with parameters as at a point 3. As a result of this mixing, the liquid fully absorbs the vapor, and obtains parameters as at a point 11. The composition of the solution having parameters as at the point 11 corresponds to a state of saturated liquid, but the composition of the solution is such that a concentration of the low boiling component in the solution at the point 11 is higher than a concentration of the low boiling component in the solution at the points 2 and 3. The solution having that composition at the point 11 will hereafter be referred to as a first working solution.

The stream of first working solution, with parameters as at the point 11, enters a pump P2, where it is pumped to an elevated pressure, hereafter referred to as a high pressure, and obtains parameters as at the point 12. Thereafter, the stream of the first working solution passes through a heat exchanger HE1, where it is heated, and obtains parameters as at a point 13. In a preferred embodiment of this system, the stream, with parameters as at the point 13, corresponds to a state of saturated or slightly sub-cooled liquid. Thereafter, the stream, with parameters as at the point 13, is divided into two sub-streams, with parameters as at points 14 and 16, respectively.

The sub-stream, with parameters as at the point 16, passes through a throttle valve TV1, where its pressure is reduced to the intermediate pressure (see above) and obtains parameters as at a point 17. As a result of the throttling in the process 16–17, the stream, with parameters as at the point 17, corresponds to a state of a two-phase fluid, i.e., a mixture of saturated liquid and saturated vapor. The stream, with parameters as at the point 17, is then sent into a separator S1, where liquid is separated from vapor. The vapor, leaving the separator S1, with parameters as at a point 62, is then mixed with another stream of vapor having parameters as at a point 63, thus creating a stream of vapor having parameters as at the point 64. This stream of vapor, with parameters as at the point 64, is then mixed with liquid stream, with parameters as at the point 3, creating a stream, with parameters as at the point 11 (see above).

The sub-stream of first working solution, with parameters as at the point 14, passes through a heat exchanger HE2, where it is heated and partially vaporized, leaving the heat exchanger HE2 as a stream, with parameters as at a the point 15, corresponding to a state of a two-phase fluid. The stream of first working solution, with parameters as at the point 15, then enters into a separator S2, where liquid is separated from vapor. A liquid stream leaving the separator S2 has parameters as at a point 21; while a vapor stream leaving separator S2 has parameters as at a point 61.

The stream of liquid, with parameters as at the point 21, is then divided into two sub-streams having parameters as at points 22 and 23, respectively. The sub-stream of liquid, with parameters as at the point 22, passes through a throttle value TV2, where its pressure is reduced to the intermediate pressure, and as a result the stream obtains parameters as at a point 24, corresponding to a state of a two-phase fluid. The stream, with parameters as at the point 24, is then sent into a separator S3, where it is separated into a stream of saturated vapor having parameters as at the point 63, and a stream of saturated liquid having parameters as at a point 31. The stream of vapor, with parameters as at the point 63, is mixed with the stream of vapor, with parameters as at the point 62, and forms the stream of vapor, with parameters as at the point 64 (see above).

The sub-stream of liquid, with parameters as at the point 23, is mixed with the stream of vapor, with parameters as at the point 61, forming a new stream having parameters as at a point 71. The new stream, with parameters as at the point 71, is referred to as a second working solution.

The stream of second working solution, with parameters as at the point 71, is sent through a heat exchanger HE3, where it is heated and fully vaporized, so that the stream has parameters as at a point 72. A composition of the stream of the second working solution, in the process 71–72 is chosen such that stream having the parameters at the point 72 corresponds to stream having a state of saturated or superheated vapor. The stream of second working solution, with parameters as at the point 72, passes through a turbine T1, where it is expanded, producing useful work, and leaves turbine T1 as a spent stream having parameters as at a point 73.

The stream of liquid, with parameters as at the point 31, leaving separator S3 (see above) passes through a throttle value TV3, where its pressure is reduced to a pressure equal to a pressure of the stream at the point 73, and the stream obtains parameters as at a point 32. Then the streams with parameters as at the points 73 and 32 are combined, forming a stream of condensing solution having parameters as at a point 81. The stream, with parameters as at the point 81, passes through the heat exchanger HE1 in counter-flow to the entering stream, with parameters as at the point 12, where the stream, with parameters as at the point 81, is partially condensed, releasing heat, and forming a stream with parameters as at a point 82. The heat released in a process 81-82 is utilized to provide heat to the process 12–13 (see above).

The stream of liquid, with parameters as at a point 41, leaving the separator S1, passes through a throttle valve TV4, where its pressure is reduced to a pressure equal to the pressure of the stream, with parameters as at the point 82, and the stream obtains parameters as at a point 42. Thereafter, the streams, with parameters as at the points 42 and 82, are combined, forming a stream of basic solution having parameters as at a point 1. The stream, with parameters as at the point 1, passes through a condenser, i.e., a heat exchanger HE4, where it is cooled and fully condensed, forming a stream having parameters as at the point 2. The cooling and condensation of the stream, with parameters as at the point 1 to the stream, with parameters at as the point 2 in the process 1–2 is provided by a stream of ambient fluid (air or water) which enters the heat exchanger HE4 with parameters as at a point 91 and exists the heat exchanger HE4 with parameters as at a point 92.

A stream of hot geothermal fluid, with initial parameters as at a point 51, passes through a heat exchanger HE3, in counter-flow to the stream having parameters as at the point 71, providing heat for the process 71–72, and the geothermal stream, with parameter as at the point 51, forms a geothermal stream having parameters as at a point 52. Thereafter, the stream geothermal fluid, with parameters as at the point 52, passes though the heat exchanger HE2, where it is further cooled, providing heat for the process 14–15. The thermodynamic cycle involving the basic working solution is a closed cycle.

Figure 1B:
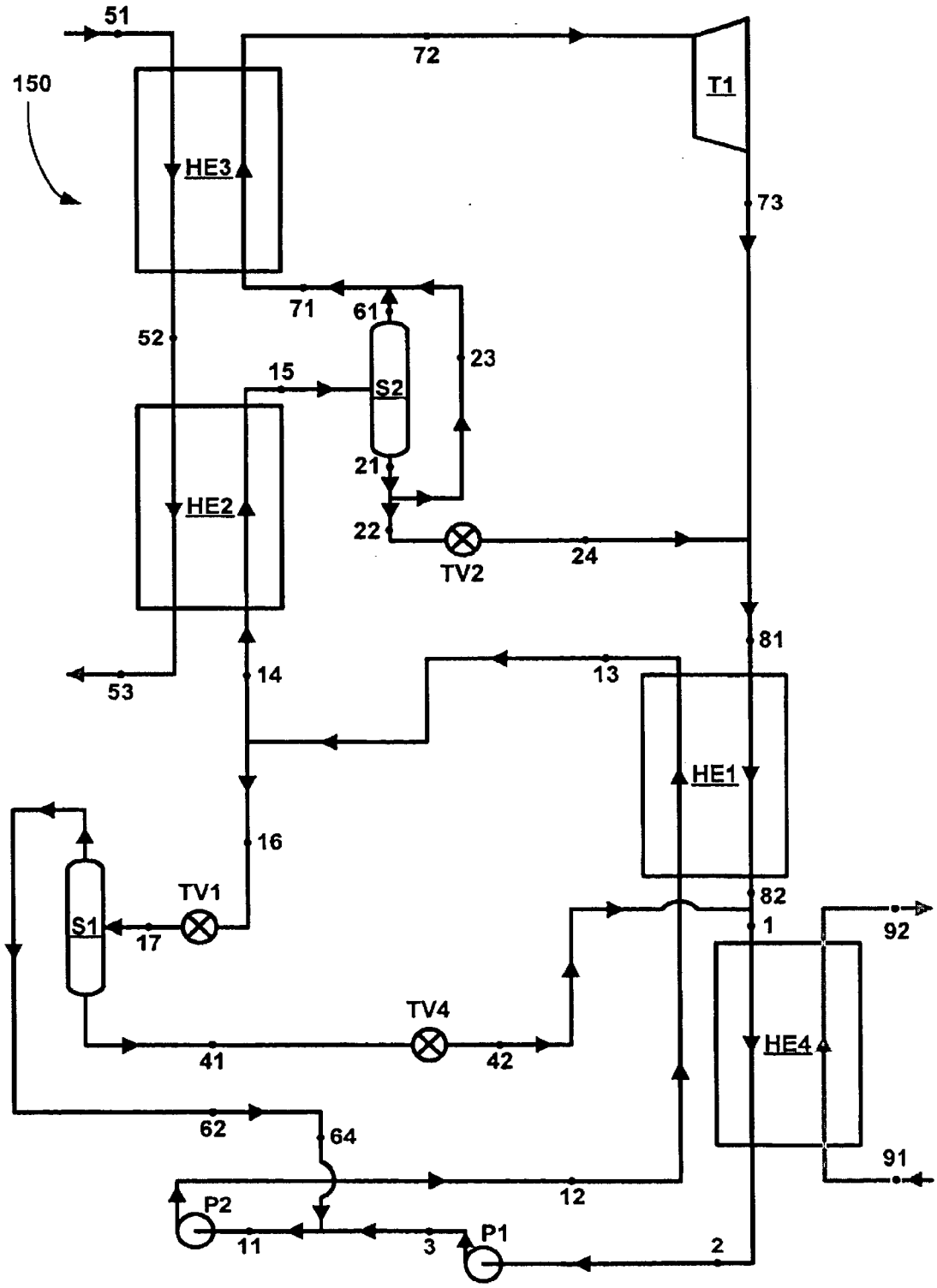

In a simplified preferred embodiments of the system and process of this invention, generally 150, a separator S3 and a throttle valve TV3 can be excluded as shown in FIG. 1B. In such a case, a pressure of the stream of liquid, with parameters as at the point 22, is reduced in the throttle valve TV2, in one step to a stream having parameters at a point 24, where a pressure of the stream is equal to a pressure of the turbine exhaust stream, with parameters as at the point 73. Once the pressure of the stream, with parameters as at the point 22, has been reduced, forming the stream, with parameters as at the point 24, the stream, with parameters at the point 24, is mixed with this turbine exhaust stream, with parameters as at the point 73, forming a condensing stream, with parameters as at the point 81. As a result, the stream of vapor with parameters as at the point 63 of the system 100 of FIG. 1A, does not exist, and the absence of the stream, with parameters as at the point 63 of the system 100, reduces a rate of enrichment of the basic solution in the process of mixing the stream with parameters as at the point 63 of the system 100 with the stream having parameters as at the point 64. Additionally, the basic solution will become slightly richer and therefore the pressure after the turbine must be slightly increased. As a result, such a simplified version wilt have slightly lower overall efficiency.

Figure 2:
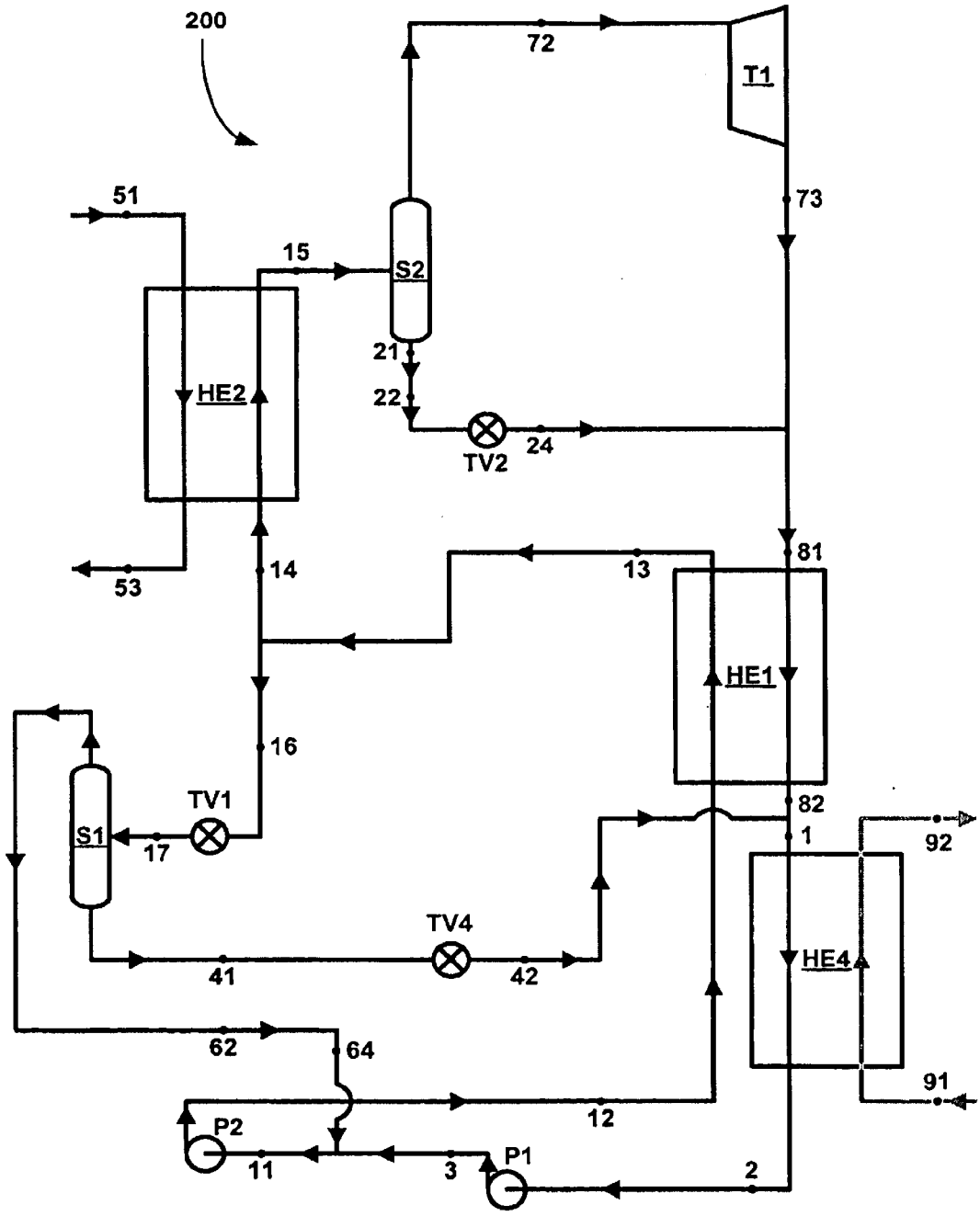
FIG. 2 depicts a diagram of another preferred embodiment of a system of this invention for converting heat from a geothermal source to a useful form of energy.

Referring now to FIG. 2, a further simplified preferred embodiment of this invention, generally 200, is shown. The system 200 not only excludes the separator S3 and the throttle valve TV3 of the system 100, the system 200 also excludes the heat exchanger HE3. Thus, the vapor stream, with parameters as at the point 72, is forwarded directly to the turbine T1. In such a case, the separator S2 is preferred a very high quality and very efficient separator or separating apparatus to prevent or minimize droplets of liquid in the stream, with parameters as at the point 72, as it enters the turbine T1.

Figure 3:
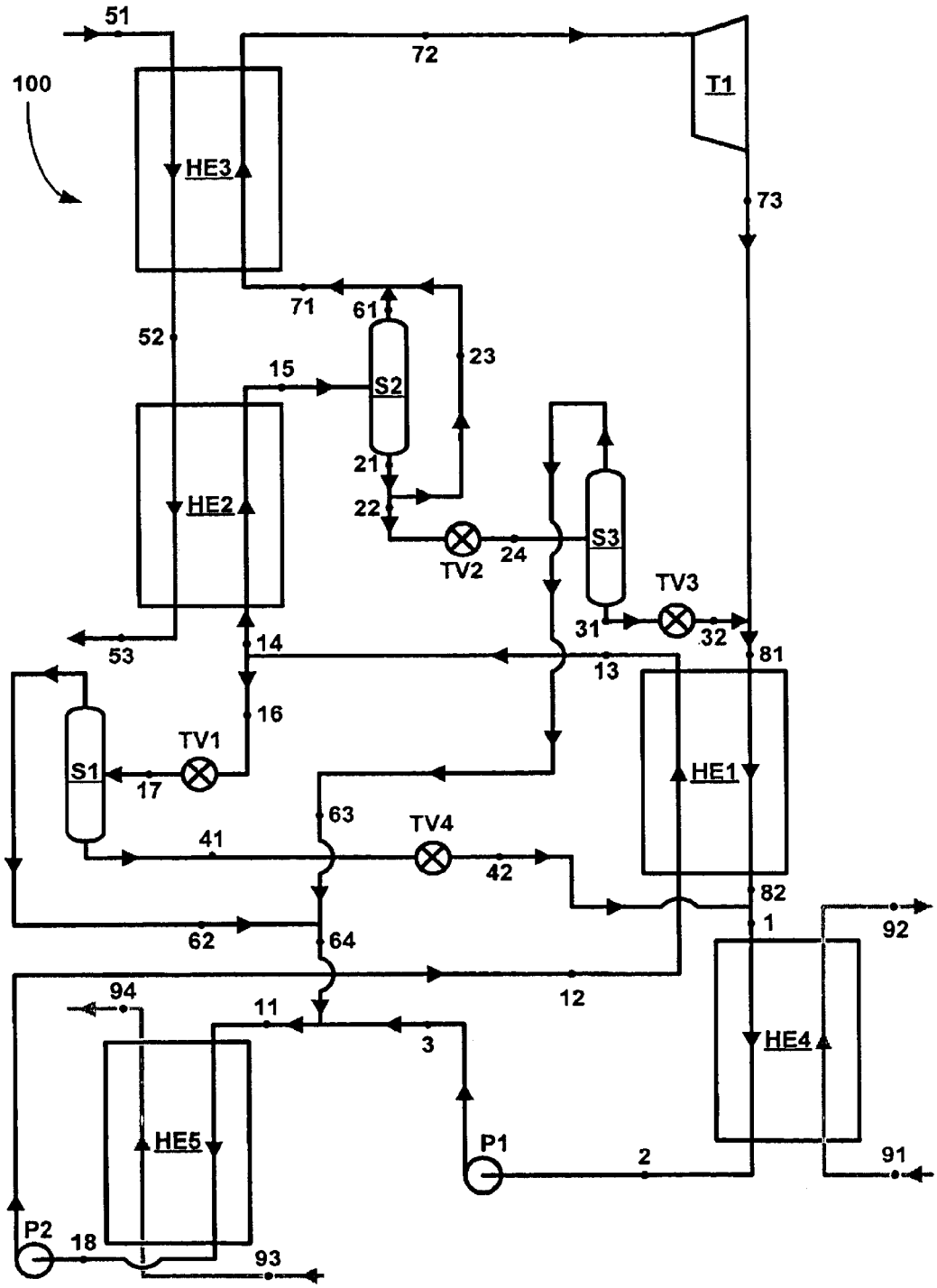
FIG. 3 depicts a diagram of another preferred embodiment of a system of this invention for converting heat from a geothermal source to a useful form of energy and FIG. 4 depicts a diagram of another preferred embodiment of a system of this invention for converting heat from a geothermal source to a useful form of energy.

Referring to FIG. 3, another preferred embodiment of the system and process of this invention, generally 300, is shown, which has enhanced efficiency through the addition of a fifth heat exchanger. When liquid streams, having parameters as at points 17 and 22, respectively, are throttled in the throttling valves TV1 and TV2, the quantities of vapor produced in these processes will increase as the pressure after the throttle valves is decreased. Therefore, flow rates of the streams having parameters as at the point 62 and 63 will be increase, which in turn increases a flow rate of the stream have parameters as at the point 64. But this will in turn require lowering a pressure of the liquid stream having parameters as at the point 3 leaving the pump P1, and, therefore, reduce an ability of the stream having parameters as at the point 3 to absorb the vapor stream having the parameters as at the point 64. When the liquid stream having parameters as at the point 3 and the vapor stream having parameters as at the point 64 are mixed, it may be necessary to install an additional condenser or heat exchanger HE5 into which the stream having parameters as at the point 11 is sent. As a result, the fully condensed stream having parameters as at a point 18 is produced. Thereafter, the stream having parameters as at the point 18 is sent into the pump P2. In this preferred embodiment, the streams of liquid having the parameters as at the point 32 and 42 become leaner (i.e., contain a smaller concentration of the low boiling component, e.g., a smaller concentration of ammonia in a water-ammonia mixture), and a composition of the streams having parameters as at the points 1, 2 and 73 also correspondingly become leaner, which results in a lowering of a pressure of the streams having parameters 1, 2 and 73 increasing the work output of the turbine T1.

The introduction of the additional condenser or heat exchanger HE5 does not increase the total quantity of heat which is rejected to the ambient surroundings. To the contrary, the amount of heat rejected to the ambient is decreased as a result of the increased output of the turbine T1. In general, the embodiment 300 of FIG. 3 is more efficient than the embodiment 100 of FIG. 1.

Figure 4:
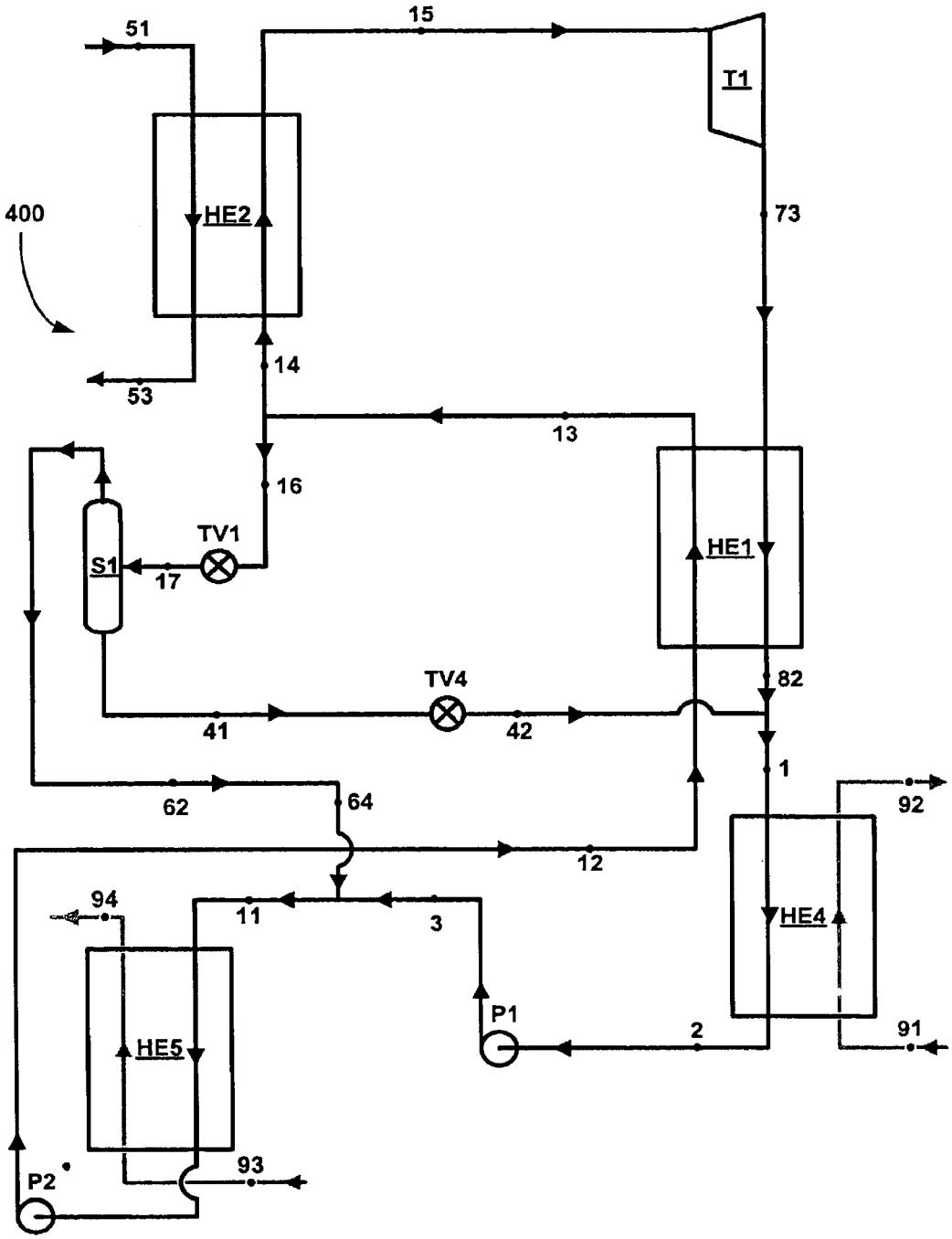

The embodiment 300 of FIG. 3 provides for a significantly higher degree of enrichment of the basic working solution in the process of mixing it with a stream of vapor having parameters as at the point 64. This, in turn, allows for a significant simplification of this embodiment. The first working solution may be enriched to such an extend that it can be used as a second working solution, thus excluding the need for two separate working solutions. Such a simplified version of this embodiment, generally 400, is shown in FIG. 4. The system 400 differs from the system 300 of FIG. 3 as set forth below.

The working solution form in the condenser or heat exchanger HE5, after being heated by a stream of turbine exhaust in the heat exchanger HE1, is divided into two sub-streams having parameters as at the point 14 and 16, respectively. Thereafter, the sub-stream having parameters as at the point 14 is sent into the heat exchanger HE2, where it is vaporized in counter-flow relationship to the geothermal stream having parameters as at the point 51, forming a stream having parameters as at the point 15. A composition and pressure of the working solution must be chosen such that the stream having parameters as at the point 15 corresponds to a stream having a state of saturated or superheated vapor. Thereafter, the stream of working solution having parameters as at the point 15 passes through the turbine T1, where it expands, producing useful work. The stream exits the turbine T1 having parameters as at the point 73 is sent them through the heat exchanger HE1, where it is partially condensed, providing heat for heating the stream having parameters as at the point 12 in the heating process 12–13. After leaving the heat exchanger HE1, the stream of working solution having the parameters as at the point 73 forms a stream having parameters as at the point 82. The stream having the parameters as at the point 82 is then combined with the lean stream having parameters as at the point 42 as previously described, forming a stream of basic working solution having the parameters as at the point 1. In all other particulars, the embodiment 400 of FIG. 4 operates in the same manner as the embodiment 300 of FIG. 3.

As one can see, the variant of the proposed system presented in FIG. 4 is significantly simpler than the variant presented in FIG. 3. As compared to the system 300 presented in FIG. 3, the system 400 presented in FIG. 4 includes four heat exchangers instead of five heat exchangers, two throttled valves instead of four throttled valves and one separator instead of three separators. However, such a simplification reduces the flexibility and to some degree the efficiency of the system 400 of FIG. 4 compared to the system 300 of FIG. 3.

The choice amongst the four presented preferred embodiment of this invention depends upon the initial and final temperature of the utilized geothermal fluid stream or other heat carrying fluid stream, upon the ambient temperature, and upon economics conditions in which the system has to operate. One of ordinary skill in the art can choose the particular embodiment of this invention that best suits the conditions and constraints of the environment in which the system is to be installed and operated.

In prior art (see e.g., U.S. Pat. No. 5,029,444), the basic solution, after passing through the condenser, is pumped in one step to a high pressure, and is then sent into two heat exchangers, one of which is heated by turbine exhaust and another by liquid returning from a separator, which corresponds to liquid stream having parameters as at the point 22 of the systems of this invention. In these two heat exchangers, the basic solution is heated and then partially vaporized. But the quantity of heat required to raise the temperature by any given temperature difference in a process of vaporization is several times greater than the quantity of heat required to pre-heat a liquid by the same temperature difference. As a result, in these heat exchangers of the prior art, the heat from the returning stream of vapor and liquid is balanced only by the process of vaporization, and, therefore, is poorly utilized; i.e., excessive heat in the process of pre-heating is utilized only partially.

Moreover, if the initial temperature of the geothermal fluid is low, then a temperature of vapor exiting the turbine can be lower than an initial temperature of boiling of the basic solution. In this case, the pressure at which boiling occurs must be lowered, so as to provide for the initial boiling of the basic solution by heat exchange with the stream of turbine exhaust. Alternately, because a temperature of the vapor exiting the turbine must be higher than the initial temperature of boiling of the basic solution, a pressure of the vapor exiting the turbine has to be increased to provide, on one hand, a higher temperature of the vapor exiting the turbine, and on the other hand, a richer basic solution so that the initial temperature of boiling for the basic solution becomes lower. These results, when compared to the systems of this invention, in a lowering of the efficiency of the system in the prior art in cases where the initial temperature of the geothermal fluid or other heat source, is low.

In the prior art, in systems designed to utilize low-temperature heat sources (e.g., U.S. Pat. No. 5,953,918), the heat of condensation of the turbine exhaust stream is utilized only for preheating an upcoming high pressure stream of working solution. But for the same reason as described above, this heat is poorly utilized as well.

In contrast, in all of the embodiment of the system of this invention, the basic solution is enriched by absorbing a stream of vapor having parameters as at the point 64, thus forming the first working solution. In the embodiments 300 and 400 of FIGS. 3 and 4, respectively, this absorption is enhanced by using an additional condenser or heat exchanger HE5. In the embodiments 100, 150 and 200 of FIG. 1A, 1B and 2, the turbine exhaust is mixed with liquid from the separator S3. In the embodiment 200 of FIG. 2, the turbine exhaust is mixed with liquid from the separator S2. In all fours embodiments, the heat released in the process of the condensation of the stream of turbine exhaust (whether not the stream is mixed with addition liquid)is used only for pre-heating of the first working solution up to the boiling temperature. Because the working solution is enriched by a low-boiling component in comparison to the basic working solution, it allows a higher boiling pressure of the first and, where applicable, of the second working solutions. All heat from the condensation of turbine exhaust is effectively used by being sent into the heat exchanger HE1, a stream of the first working solution with a weight flow rate significantly higher than the flow rate of the stream of this same solution which is sent into the boiler (Heat Exchanger HE2). Excessive quantity of the first working solution is used to produce a stream of vapor with parameters as at the point 62, which is then utilized to enrich the basic solution by adding this vapor stream to it, and rowing a richer stream of the first working solution.

To sum up, it is clear that the systems of this invention can provide for a higher pressure of vapor entering the turbine and a lower pressure of vapor exiting he turbine, thus providing a higher efficiency to the system as a whole. A preliminary assessment shows that the proposed system can, at the same border conditions, provide for an increase in power output of between 10% and 20%. It should be recognized that the working solution is in a closed thermodynamic cycle and the temperatures and pressures of the streams are self adjusting so that the system operates at maximum efficiency with little or no outside monitoring or control.

All references cited herein are incorporated by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

I claim:

1. A method for implementing a thermodynamic cycle comprising the steps of:

expanding a gaseous second working stream, transforming its energy into usable form and producing a low pressure spent stream;

mixing the spent stream with a first lean stream forming a second spent stream;

heating a first working stream with the second spent stream to form a third spent stream and a heated first working stream;

mixing the third spent stream with a second lean stream to form a pre-condensed stream;

condensing the pre-condensed stream to form a liquid stream;

mixing the liquid stream with a first enriched vapor stream to form the first working stream;

forming, from a first portion of the heated first working stream, a second enriched vapor stream and the second lean stream;

heating a second portion of the heated first working stream with an external heat source fluid stream to form a partially vaporized first working stream;

forming, from the partially vaporized first working stream, a third enriched stream and a third lean stream;

forming, from a first portion of the third lean stream, the first lean stream and a third enriched stream;

mixing the third enriched stream with the second enriched stream to form the first enriched stream;

mixing a second portion of the third lean stream with the second enriched stream to form the second working stream; and fully vaporizing the second working stream with heat from the external heat source fluid stream to from the gaseous second working stream.

2. The method of claim 1, further comprising the step of:

pressurizing the liquid stream to an intermediate pressure;

pressurizing the first working stream to a high pressure;

depressurizing the first portion of the heated first working stream to the intermediate pressure;

depressurizing the second lean stream to the intermediate pressure;

depressurizing the third lean stream to the intermediate pressure; and depressurizing the first lean stream to the low pressure.

3. A method for implementing a thermodynamic cycle comprising the steps of:

expanding a gaseous second working stream, transforming its energy into usable form and producing a low pressure spent stream;

mixing the spent stream with a first lean stream forming a second spent stream;

heating a first working stream with the second spent stream to form a third spent stream and a heated first working stream;

mixing the third spent stream with a second lean stream to form a pre-condensed stream;

condensing the pre-condensed stream to form a liquid stream;

mixing the liquid stream with a first enriched vapor stream to form the first working stream;

forming, from a first portion of the heated first working stream, a second enriched vapor stream and the second lean stream;

heating a second portion of the heated first working stream with an external heat source fluid stream to form a partially vaporized first working stream;

forming, from the partially vaporized first working stream, a third enriched stream and the first lean stream at the intermediate pressure;

mixing a second portion of the third lean stream with the second enriched stream to form the second working stream; and fully vaporizing the second working stream with heat from the external heat source fluid stream to from the gaseous second working stream.

4. The method of claim 3, further comprising the step of:

pressurizing the liquid stream to an intermediate pressure;

pressurizing the first working stream to a high pressure;

depressurizing the first portion of the heated first working stream to the intermediate pressure;

depressurizing the second lean stream to the intermediate pressure; and depressurizing the first lean stream to the low pressure.

5. A method for implementing a thermodynamic cycle comprising the steps of:

expanding a gaseous second working stream, transforming its energy into usable form and producing a low pressure spent stream;

mixing the spent stream with a first lean stream forming a second spent stream;

heating a first working stream with the second spent stream to form a third spent stream and a heated first working stream;

mixing the third spent stream with a second lean stream to form a pre-condensed stream;

condensing the pre-condensed stream to form a liquid stream;

mixing the liquid stream with a first enriched vapor stream to form the first working stream;

forming, from a first portion of the heated first working stream, a second enriched vapor stream and the second lean stream;

heating a second portion of the heated first working stream with an external heat source fluid stream to form a partially vaporized first working stream; and forming, from the partially vaporized first working stream, the gaseous second working stream and the first lean stream.

6. The method of claim 5, further comprising the step of:

pressurizing the liquid stream to an intermediate pressure;

pressurizing the first working stream to a high pressure;

depressurizing the first portion of the heated first working stream to the intermediate pressure;

depressurizing the second lean stream to the intermediate pressure; and depressurizing the first lean stream to the low pressure.

7. A method for implementing a thermodynamic cycle comprising the steps of:

expanding a gaseous second working stream, transforming its energy into usable form and producing a low pressure spent stream;

mixing the spent stream with a first lean stream forming a second spent stream;

heating a fully condensed first working stream with the second spent stream to form a third spent stream and a heated first working stream;

mixing the third spent stream with a second lean stream to form a pre-condensed stream;

condensing the pre-condensed stream to form a liquid stream;

mixing the liquid stream with a first enriched vapor stream to form a first working stream;

condensing the first working stream to form the fully condensed first working stream;

forming, from a first portion of the heated first working stream, a second enriched vapor stream and the second lean stream;

heating a second portion of the heated first working stream with an external heat source fluid stream to form a partially vaporized first working stream;

forming, from the partially vaporized first working stream, a third enriched stream and a third lean stream;

forming, from a first portion of the third lean stream, the first lean stream and a third enriched stream;

mixing the third enriched stream with the second enriched stream to form the first enriched stream;

mixing a second portion of the third lean stream with the second enriched stream to form the second working stream;

fully vaporizing the second working stream with heat from the external heat source fluid stream to from the gaseous second working stream.

8. The method of claim 7, further comprising the step of:

pressurizing the liquid stream to an intermediate pressure;

pressurizing the first working stream to a high pressure;

depressurizing the first portion of the heated first working stream to the intermediate pressure;

depressurizing the second lean stream to the intermediate pressure;

depressurizing the third lean stream to the intermediate pressure; and depressurizing the first lean stream to the low pressure.

9. A method for implementing a thermodynamic cycle comprising the steps of:

expanding a gaseous working stream, transforming its energy into usable form and producing a low pressure spent stream;

heating a fully condensed working stream with the spent stream to form a second spent stream and a heated working stream;

mixing the second spent stream with a lean stream to form a pre-condensed stream;

condensing the pre-condensed stream to form a liquid stream;

mixing the liquid stream with an enriched vapor stream to form an enriched liquid stream;

condensing the enriched liquid stream to form the fully condensed working stream;

forming, from a first portion of the heated working stream, the enriched vapor stream and the lean stream; and fully vaporizing a second portion of the heated working stream with an external heat source fluid stream to form the gaseous working stream.

10. The method of claim 9, further comprising the step of:

pressurizing the liquid stream to an intermediate pressure;

pressurizing the enriched liquid stream to a high pressure;

depressurizing the first portion of the heated working stream to the intermediate pressure; and depressurizing the lean stream to the intermediate pressure.

11. An apparatus for implementing a thermodynamic cycle comprising:

means for expanding a gaseous second working stream, transferring its energy into usable form and producing a low pressure spent stream;

a first stream mixer for mixing the low pressure spent stream with a first lean stream forming a lean spent stream;

a first heat exchanger for heating a high pressure liquid first working stream with heat transferred from the lean spent stream to form a heated liquid first working stream;

a second stream mixer for mixing the lean spent stream with a second lean stream to form a pre-condensed stream;

a condenser for condensing the pre-condensed stream producing a liquid stream;

a first pump for pumping the liquid stream to an intermediate pressure;

a third stream mixer for mixing the intermediate pressure liquid stream with a first enriched vapor stream forming the liquid first working stream;

a second pump for pumping the liquid first working stream to a high pressure;

a first stream splitter for forming to sub-streams of the high pressure liquid first working stream;

a first throttle valve for reducing the pressure of one of the sub-streams of the high pressure liquid first working stream to the intermediate pressure;

a first gravity separator for forming a second enriched vapor stream and the second lean stream at the intermediate pressure from the intermediate pressure sub-stream;

a fourth stream mixer for mixing the second enriched vapor stream with a third enriched vapor stream to form the first enriched vapor stream;

a second throttle valve for reducing the pressure of the second lean stream at the intermediate pressure to the low pressure of the lean spent stream;

a second heat exchanger for heating the other sub-stream of the high pressure liquid first working stream with heat transferred from a low-temperature fluid stream from an external heat source to produce a partially vaporized high pressure first working stream;

a second gravity separator for forming from a fourth enriched vapor stream and a third lean stream from the partially vaporized high pressure first working stream;

a second stream splitter for forming to sub-streams of the third lean stream;

a third throttle valve for reducing the pressure of one of the sub-streams of the third lean stream to the intermediated pressure;

a third gravity separator for forming the third enriched vapor stream and the first lean stream at the intermediate pressure from the intermediate pressure third lean stream;

a fourth throttle valve for reducing the pressure of the intermediate pressure first lean stream to the low pressure of the spent stream;

a fifth stream mixer for mixing the fourth enriched vapor stream with the other sub-stream of the third lean stream to form a second working stream; and a third heat exchanger for fully vaporizing the second working stream to form the gaseous second working steam.

12. An apparatus for implementing a thermodynamic cycle comprising:

means for expanding a gaseous second working stream, transferring its energy into usable form and producing a low pressure spent stream;

a first stream mixer for mixing the low pressure spent stream with a first lean stream forming a lean spent stream;

a first heat exchanger for heating a high pressure liquid first working stream with heat transferred from the lean spent stream to form a heated liquid first working stream;

a second stream mixer for mixing the lean spent stream with a second lean stream to form a pre-condensed stream;

a condenser for condensing the pre-condensed stream producing a liquid stream;

a first pump for pumping the liquid stream to an intermediate pressure;

a third stream mixer for mixing the intermediate pressure liquid stream with a first enriched vapor stream forming the liquid first working stream;

a second pump for pumping the liquid first working stream to a high pressure;

a first stream splitter for forming to sub-streams of the high pressure liquid first working stream;

a first throttle valve for reducing the pressure of one of the sub-streams of the high pressure liquid first working stream to the intermediate pressure;

a first gravity separator for forming the first enriched vapor stream and the second lean stream at the intermediate pressure from the intermediate pressure sub-stream;

a second throttle valve for reducing the pressure of the second lean stream at the intermediate pressure to the low pressure of the lean spent stream;

a second heat exchanger for heating the other sub-stream of the high pressure liquid first working stream with heat transferred from a low-temperature fluid stream from an external heat source to produce a partially vaporized high pressure first working stream;

a second gravity separator for forming from a second enriched vapor stream and the first lean stream at the high pressure from the partially vaporized high pressure first working stream;

a second stream splitter for forming to sub-streams of the high pressure first lean stream;

a third throttle valve for reducing the pressure of one of the sub-streams of the high pressure first lean stream to the low pressure;

a fourth stream mixer for mixing the second enriched vapor stream with the other sub-stream of the high pressure first lean stream to form a second working stream; and a third heat exchanger for fully vaporizing the second working stream to form the gaseous second working steam.

13. An apparatus for implementing a thermodynamic cycle comprising:

means for expanding a gaseous second working stream, transferring its energy in to usable form and producing a low pressure spent stream;

a first stream mixer for mixing the low pressure spent stream with a first lean stream forming a lean spent stream;

a first heat exchanger for heating a high pressure liquid first working stream with heat transferred from the lean spent stream to form a heated liquid first working stream;

a second stream mixer for mixing the lean spent stream with a second lean stream to form a pre-condensed stream;

a condenser for condensing the pre-condensed stream producing a liquid stream;

a first pump for pumping the liquid stream to an intermediate pressure;

a third stream mixer for mixing the intermediate pressure liquid stream with a first enriched vapor stream forming the liquid first working stream;

a second pump for pumping the liquid first working stream to a high pressure;

a first stream splitter for forming to sub-streams of the high pressure liquid first working stream;

a first throttle valve for reducing the pressure of one of the sub-streams of the high pressure liquid first working stream to the intermediate pressure;

a first gravity separator for forming the first enriched vapor stream and the second lean stream at the intermediate pressure from the intermediate pressure sub-stream;

a second throttle valve for reducing the pressure of the second lean stream at the intermediate pressure to the low pressure of the lean spent stream;

a second heat exchanger for heating the other sub-stream of the high pressure liquid first working stream with heat transferred from a low-temperature fluid stream from an external heat source to produce a partially vaporized high pressure first working stream;

a second gravity separator for forming from the gaseous second working stream and the first lean stream at the high pressure from the partially vaporized high pressure first working stream; and a third throttle valve for reducing the pressure of one of the sub-streams of the high pressure first lean stream to the low pressure.

14. An apparatus for implementing a thermodynamic cycle comprising:

means for expanding a gaseous second working stream, transferring its energy into usable form and producing a low pressure spent stream;

a first stream mixer for mixing the low pressure spent stream with a first lean stream forming a lean spent stream;

a first heat exchanger for heating a high pressure liquid first working stream with heat transferred from the lean spent stream to form a heated liquid first working stream;

a second stream mixer for mixing the lean spent stream with a second lean stream to form a pre-condensed stream;

a first condenser for condensing the pre-condensed stream producing a liquid stream;

a first pump for pumping the liquid stream to an intermediate pressure;

a third stream mixer for mixing the intermediate pressure liquid stream with a first enriched vapor stream forming an enriched mixed stream;

a second condenser for condensing the enriched mixed stream forming the liquid first working stream;

a second pump for pumping the liquid first working stream to a high pressure;

a first stream splitter for forming to sub-streams of the high pressure liquid first working stream;

a first throttle valve for reducing the pressure of one of the sub-streams of the high pressure liquid first working stream to the intermediate pressure;

a first gravity separator for forming a second enriched vapor stream and the second lean stream at the intermediate pressure from the intermediate pressure sub-stream;

a fourth stream mixer for mixing the second enriched vapor stream with a third enriched vapor stream to form the first enriched vapor stream;

a second throttle valve for reducing the pressure of the second lean stream at the intermediate pressure to the low pressure of the lean spent stream;

a second heat exchanger for heating the other sub-stream of the high pressure liquid first working stream with heat transferred from a low-temperature fluid stream from an external heat source to produce a partially vaporized high pressure first working stream;

a second gravity separator for forming from a fourth enriched vapor stream and a third lean stream from the partially vaporized high pressure first working stream;

a second stream splitter for forming to sub-streams of the third lean stream;

a third throttle valve for reducing the pressure of one of the sub-streams of the third lean stream to the intermediated pressure;

a third gravity separator for forming the third enriched vapor stream and the first lean stream at the intermediate pressure from the intermediate pressure third lean stream;

a fourth throttle valve for reducing the pressure of the intermediate pressure first lean stream to the low pressure of the spent stream;

a fifth stream mixer for mixing the fourth enriched vapor stream with the other sub-stream of the third lean stream to form a second working stream; and a third heat exchanger for fully vaporizing the second working stream to form the gaseous second working steam.

15. An apparatus for implementing a thermodynamic cycle comprising:

means for expanding a gaseous working stream, transferring its energy into usable form and producing a low pressure spent stream;

a first heat exchanger for heating a high pressure liquid working stream with heat transferred from the spent stream to form a heated high pressure liquid working stream;

a first stream mixer for mixing the spent stream with a lean stream to form a pre-condensed stream;

a first condenser for condensing the pre-condensed stream producing a liquid stream;

a first pump for pumping the liquid stream to an intermediate pressure;

a second stream mixer for mixing the intermediate pressure liquid stream with an enriched vapor stream forming an enriched mixed stream;

a second condenser for condensing the enriched mixed stream forming the liquid first working stream;

a second pump for pumping the liquid first working stream to a high pressure forming the high pressure liquid working stream;

a first stream splitter for forming to sub-streams of the high pressure liquid working stream;

a first throttle valve for reducing the pressure of one of the sub-streams of the high pressure liquid working stream to the intermediate pressure;

a first gravity separator for forming the enriched vapor stream and the lean stream at the intermediate pressure from the intermediate pressure sub-stream;

a second throttle valve for reducing the pressure of the lean stream at the intermediate pressure to the low pressure of the spent stream; and a second heat exchanger for heating the other sub-stream of the high pressure liquid working stream with heat transferred from a low-temperature fluid stream from an external heat source to produce the gaseous working stream.

16. A method for implementing a thermodynamic cycle comprising the steps of:

expanding a gaseous working stream, transforming its energy into usable form and producing a spent stream;

heating a liquid first working stream with the spent stream to form a heated first working stream and a cooled spent stream;

mixing the cooled spent stream with a lean stream to form a pre-condensed stream;

condensing the pre-condensed stream producing a liquid stream;

mixing the liquid stream with an enriched vapor stream to form the liquid first working stream;

forming, from a depressurized first portion of the liquid first working stream, the enriched vapor stream and the lean stream; and heating a second portion of the liquid first working stream to form the gaseous working stream.

17. The method of claim 16, further comprising the step of:

pressurizing the liquid stream to an intermediate pressure prior to mixing the liquid stream with the enriched vapor stream;

heating the liquid first working stream to form a heated liquid first working stream ;

pressurizing the first working stream to a high pressure prior to heating the first working stream with the spent stream;

depressurizing the first portion of the heated first working stream to the intermediate pressure; and depressurizing the lean stream to a pressure of the spent stream.

* * * * *